US012557880B2

(12) United States Patent
Kohatsu et al.

(10) Patent No.: US 12,557,880 B2
(45) **Date of Patent: *Feb. 24, 2026**

(54) ARTICLES OF FOOTWEAR AND OTHER FOOT-RECEIVING DEVICES HAVING DYNAMICALLY ADJUSTABLE HEEL PORTIONS

(71) Applicant: NIKE, Inc., Beaverton, OR (US)

(72) Inventors: Shane S. Kohatsu, Portland, OR (US); Matthew C. Palmer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/823,836

(22) Filed: Sep. 4, 2024

(65) Prior Publication Data

US 2024/0423324 A1 Dec. 26, 2024

Related U.S. Application Data

(63) Continuation of application No. 17/525,629, filed on Nov. 12, 2021, now Pat. No. 12,108,834.

(51) Int. Cl.
*A43B 23/08* (2006.01)
*A43B 23/02* (2006.01)

(52) U.S. Cl.
CPC ..... *A43B 23/088* (2013.01); *A43B 23/0235* (2013.01); *A43B 23/027* (2013.01); *A43B 23/086* (2013.01)

(58) Field of Classification Search
CPC ..... A43B 23/088; A43B 23/0295
See application file for complete search history.

(56) References Cited

U.S. PATENT DOCUMENTS 2,789,374 A * 4/1957 Planert ..... A63B 71/1225 36/89
3,040,454 A 6/1962 Topper et al.
3,665,619 A * 5/1972 Gray ..... A43B 5/0415 36/117.1

(Continued)

FOREIGN PATENT DOCUMENTS

EP 2316292 A1 5/2011
WO 9320725 A1 10/1993

(Continued)

OTHER PUBLICATIONS

Dec. 12, 2022—(WO) ISR & WO—App. No. PCT/US2022/076498.

*Primary Examiner* — Jillian K Pierorazio
(74) *Attorney, Agent, or Firm* — Banner & Witcoff, Ltd.

(57) ABSTRACT

Articles of footwear having an upper including a dynamic fit heel portion and a main body. The dynamic fit heel portion may include a lower heel counter and an upper heel collar. The upper heel collar may define at least in part, a foot-receiving chamber. An expandable joint may be provided between the lower heel counter and the upper heel collar. A material forming the expandable joint may have a higher flexibility and a higher stretch than the lower heel counter and the upper heel collar. The lower heel counter, the upper heel collar, and the expandable joint may be configured to align with portions of a heel and ankle of a wearer so as to provide a flexible heel and ankle fit.

20 Claims, 9 Drawing Sheets

(56) References Cited

U.S. PATENT DOCUMENTS 4,559,722 A * 12/1985 Norton ..... A43B 23/0235 36/105
4,594,798 A * 6/1986 Autry ..... A43B 23/17 36/114
4,670,998 A * 6/1987 Pasternak ..... A43B 7/1495 36/114
5,243,772 A * 9/1993 Francis ..... A43B 7/20 36/3 R
5,319,869 A * 6/1994 McDonald ..... A43B 23/0235 36/114
5,533,279 A * 7/1996 Mitsui ..... A43B 23/0235 36/55
5,765,296 A * 6/1998 Ludemann ..... A43B 23/047 36/97
6,367,171 B1 * 4/2002 Burt ..... A43B 3/24 36/105
6,594,921 B2 7/2003 Laio et al.
6,804,901 B2 * 10/2004 Joubert ..... A43B 17/02 36/89
D536,516 S 2/2007 Sanders
7,243,444 B2 * 7/2007 Selner ..... A61F 5/0111 36/144
D575,488 S 8/2008 Covatch
7,685,747 B1 3/2010 Gasparovic et al.
7,743,531 B2 6/2010 Aveni et al.
D619,348 S 7/2010 Schwartz et al.
7,823,298 B2 * 11/2010 Nishiwaki ..... A43B 5/10 36/97
D628,782 S 12/2010 Butler
7,950,676 B2 * 5/2011 Goldsmith ..... A43B 5/1683 280/11.12
8,713,821 B2 * 5/2014 Nishiwaki ..... A43B 23/047 36/97
9,095,188 B2 * 8/2015 Cavaliere ..... A43B 7/14
D767,269 S 9/2016 Lovett et al.
9,629,418 B2 4/2017 Rushbrook et al.
9,675,130 B2 * 6/2017 Ueda ..... A43B 3/0078
9,756,903 B1 9/2017 Koo
9,839,261 B2 12/2017 Hatfield et al.
10,602,797 B2 3/2020 Lintaman
10,694,816 B2 6/2020 Turner et al.
10,758,009 B2 9/2020 Dojan et al.
10,813,405 B2 10/2020 Pratt
11,351,051 B1 * 6/2022 Ostergard ..... A43B 7/20
2004/0088890 A1 * 5/2004 Matis ..... A43C 11/006 36/105
2004/0111921 A1 * 6/2004 Lenormand ..... A43B 23/047 36/45
2005/0229436 A1 * 10/2005 Bock ..... A43B 5/1691 36/89
2006/0075663 A1 * 4/2006 Nakano ..... A43B 7/20 36/89
2008/0028640 A1 * 2/2008 Lacorazza ..... A43B 23/0295 36/97
2008/0083138 A1 * 4/2008 Lacorazza ..... A43B 3/26 36/97
2009/0014424 A1 * 1/2009 Meschter ..... A43B 23/0255 219/121.69
2010/0319216 A1 12/2010 Grenzke et al.
2012/0204452 A1 * 8/2012 Van Horne ..... A43B 5/1691 36/115
2013/0186786 A1 * 7/2013 Curtis ..... A43B 3/0078 36/102
2013/0239439 A1 * 9/2013 Ludemann ..... B29D 35/0009 36/109
2014/0130380 A1 * 5/2014 Anderson ..... A43B 23/16 36/107
2014/0237858 A1 * 8/2014 Adami ..... A43B 13/141 36/107
2014/0360048 A1 * 12/2014 DeHaven ..... A43B 23/0295 36/83
2016/0095735 A1 4/2016 Wenger
2016/0192730 A1 * 7/2016 Ludemann ..... A43B 23/0235 12/142 E
2017/0367437 A1 * 12/2017 Ludemann ..... A43B 23/026
2018/0064210 A1 * 3/2018 Turner ..... A43B 23/0235
2018/0103727 A1 * 4/2018 Fracassi ..... A43B 23/026
2018/0360164 A1 * 12/2018 Markison ..... A43B 23/027
2019/0000180 A1 * 1/2019 Moriyasu ..... A43B 23/0275
2019/0116917 A1 4/2019 Sato et al.
2019/0116934 A1 * 4/2019 Schenone ..... A43B 23/0235
2019/0239595 A1 * 8/2019 Fallon ..... A43B 23/0235
2019/0313740 A1 * 10/2019 Workman ..... A43B 7/20
2020/0205512 A1 7/2020 Blanche et al.
2020/0253331 A1 * 8/2020 Davis ..... A43B 23/047
2020/0375315 A1 * 12/2020 Noon ..... A43B 23/0205
2021/0244126 A1 * 8/2021 Chang ..... A43C 11/24

FOREIGN PATENT DOCUMENTS

WO 9937176 A1 7/1999
WO 2008018666 A1 2/2008
WO 2009009254 A1 1/2009
WO 2010017037 A1 2/2010

* cited by examiner

ARTICLES OF FOOTWEAR AND OTHER FOOT-RECEIVING DEVICES HAVING DYNAMICALLY ADJUSTABLE HEEL PORTIONS

CROSS-REFERENCE TO RELATED APPLICATIONS

This application is a continuation of U.S. patent application Ser. No. 17/525,629, filed Nov. 12, 2021, of which entirely incorporated herein by reference.

FIELD OF THE INVENTION

Aspects of the present disclosure relate to the field of footwear and other foot-receiving devices. More specifically, aspects of the present invention pertain to articles of footwear and other foot-receiving devices that include dynamically adjustable heel portion, e.g., that enable a dynamic fit of the heel portion around a wearer's foot.

BACKGROUND

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and any contact surface. In addition to attenuating ground reaction forces and absorbing energy, the sole structure may provide traction and control potentially harmful foot motion, such as over pronation. General features and configurations of uppers and sole structures are discussed in greater detail below.

The upper forms a void on the interior of the footwear for receiving the foot. The void has the general shape of the foot, and access to the void is provided at an ankle or foot-insertion opening. The upper extends over the instep and toe areas of the foot, along the medial and lateral sides of the foot, and around the heel area of the foot. A lacing system often is incorporated into the upper to selectively change the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

The sole structure generally incorporates multiple layers that are conventionally referred to as an "insole," a "midsole," and an "outsole." The insole (which also may constitute a sock liner) is a thin member located within the upper and adjacent the plantar (lower) surface of the foot to enhance footwear comfort, e.g., to wick away moisture. The midsole, which is traditionally attached to the upper along the upper's entire length, forms the middle layer of the sole structure and serves a variety of purposes that include controlling foot motions and attenuating impact forces. The outsole forms the ground-contacting element of footwear and usually is fashioned from a durable, wear-resistant material that includes texturing or other features to improve traction.

The primary element of a conventional midsole is a resilient, polymer foam material, such as polyurethane or ethylvinylacetate ("EVA"), that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, the degree of ground reaction force attenuation, and the energy absorption properties may be altered to meet the specific demands of the activity for which the footwear is intended to be used.

In many applications, proper fit around a wearer's heel and ankle may help ensure a proper fit of the article of footwear and that the article of footwear stay in place even during periods of heavy athletic activity or other physical exertion. Designing footwear to support and/or protect the foot during such periods remains an ongoing challenge.

BRIEF DESCRIPTION OF THE DRAWINGS

The following Detailed Description will be better understood when read in conjunction with the accompanying drawings in which like reference numerals refer to the same or similar elements in all of the various views in which that reference number appears.

The reader should understand that the attached drawings are not necessarily drawn to scale.

DETAILED DESCRIPTION

In the following description of various examples of footwear and foot-receiving device structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

I. TERMINOLOGY/GENERAL INFORMATION

First, some general terminology and information is provided that will assist in understanding various portions of the technology as described herein. As noted above, aspects of the present disclosure relate to the field of footwear and other foot-receiving devices, including heel portions of such devices. "Foot-receiving device" may include any device into which a user places at least some portion of his or her foot. In addition to all types of footwear (described below), foot-receiving devices may include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include: (a) one or more "foot-covering members" (e.g., akin to and including footwear upper components) that help position the foot with respect to other components or structures and (b) one or more "foot-supporting members" (e.g., akin to and including footwear sole structure components) that support at least some portion(s) of a plantar surface of a user's foot. "Securing systems," like those in accordance with at least some aspects of this technology, may help position and/or securely hold the user's foot in place with respect to the foot-covering member(s) and/or the foot-supporting member(s). "Footwear" may include any type of wearing apparel for the feet, and may further include without being limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, track shoes, track field event shoes (e.g., for high jump, triple jump, etc.), etc.), and the like. "Foot-supporting members" may include components for and/or functioning as midsoles and/or outsoles for articles of footwear (or components providing corresponding functions in non-footwear type foot-receiving devices).

Figure 4:
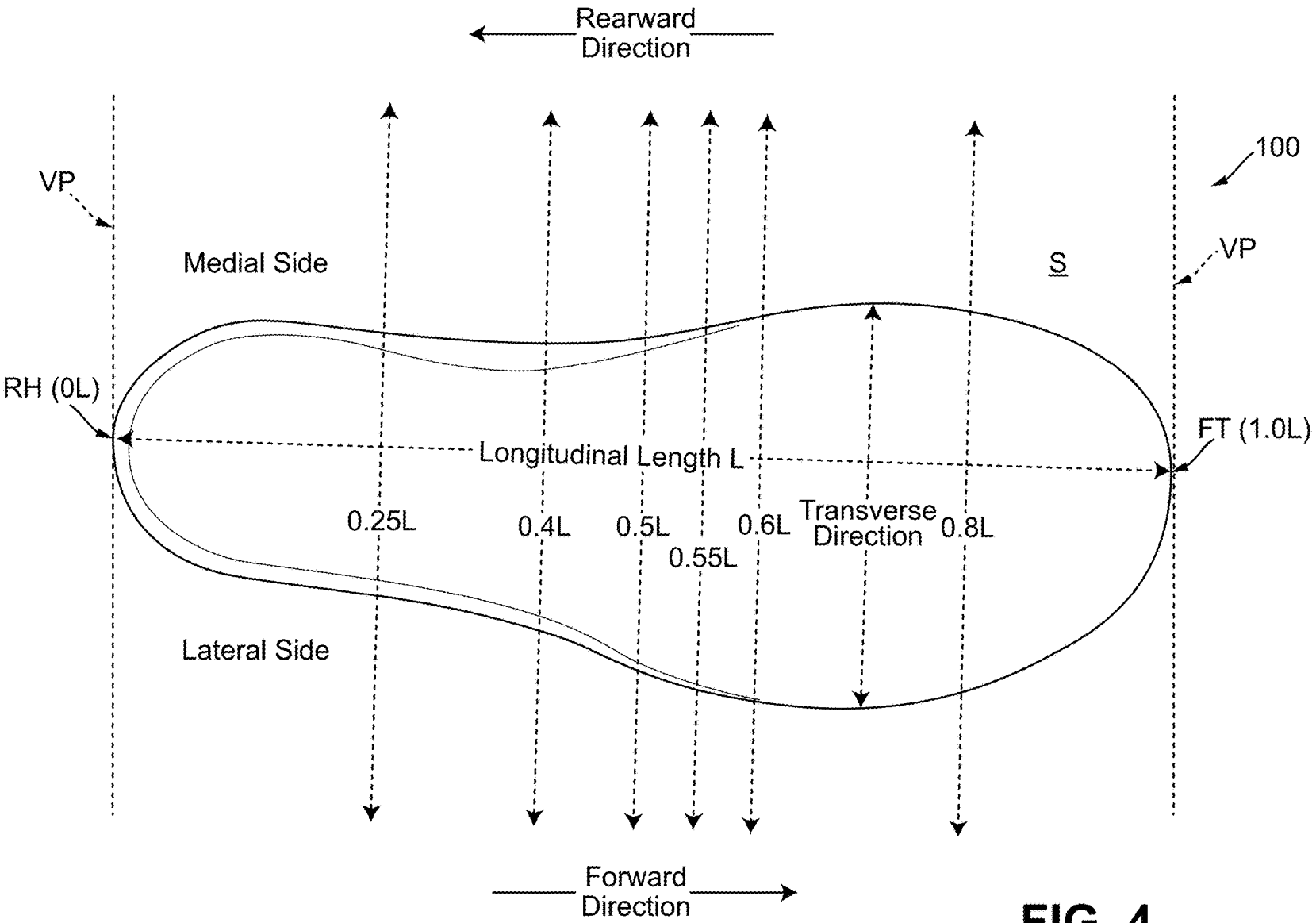
FIG. 4 is provided to help illustrate and explain background and definitional information useful for understanding certain terminology and aspects of this technology.

FIG. 4 also provides information that may be useful for explaining and understanding the specification and/or aspects of this technology. More specifically, FIG. 4 provides a representation of a footwear/foot-receiving device component 1000, which in this illustrated example constitutes a portion of a sole structure for an article of footwear. The same general definitions and terminology described below may apply to footwear and foot-receiving devices in general and/or to other footwear/foot-receiving device components or portions thereof, such as an upper, a midsole component, an outsole component, etc.

First, as illustrated in FIG. 4, the terms "forward" or "forward direction" as used herein, unless otherwise noted or clear from the context, mean toward or in a direction toward a forward-most toe area FT of the footwear or foot-receiving device structure or component 1000. The terms "rearward" or "rearward direction" as used herein, unless otherwise noted or clear from the context, mean toward or in a direction toward a rear-most heel area RH of the footwear or foot-receiving device structure or component 1000. The terms "lateral" or "lateral side" as used herein, unless otherwise noted or clear from the context, mean the outside or "little toe" side of the footwear or foot-receiving device structure or component 1000. The terms "medial" or "medial side" as used herein, unless otherwise noted or clear from the context, mean the inside or "big toe" side of the footwear or foot-receiving device structure or component 1000.

Also, various example features and aspects of this technology are disclosed or explained herein with reference to a "longitudinal direction" and/or with respect to a "longitudinal length" L of a footwear/foot-receiving device component 1000 (such as an article of footwear and/or a footwear sole structure). As shown in FIG. 4, the "longitudinal direction" is determined as the direction of a line extending from a rearmost heel location (RH in FIG. 4) to the forwardmost toe location (FT in FIG. 4) of the footwear component 1000 in question (a sole structure or foot-supporting member in this illustrated example). The "longitudinal length" L is the length dimension measured from the rearmost heel location RH to the forwardmost toe location FT. The rearmost heel location RH and the forwardmost toe location FT may be located by determining the rear heel and forward toe tangent points with respect to front and back parallel vertical planes VP when the component 1000 (e.g., sole structure or foot-supporting member in this illustrated example, e.g., as part of an article of footwear or foot-receiving device) is oriented on a horizontal support surface S in an unloaded condition (e.g., with no weight applied to it other than potentially the weight of the shoe/foot-receiving device components with which it is engaged). If the forwardmost and/or rearmost locations of a specific footwear or foot-receiving device component 1000 constitute a line segment (rather than a tangent point), then the forwardmost toe location and/or the rearmost heel location constitute the mid-point of the corresponding line segment. If the forwardmost and/or rearmost locations of a specific footwear or foot-receiving device component 1000 constitute two or more separated points or line segments, then the forwardmost toe location and/or the rearmost heel location constitute the mid-point of a line segment connecting the furthest spaced and separated points and/or furthest spaced and separated end points of the line segments (irrespective of whether the midpoint itself lies on the component 1000 structure). If the forwardmost and/or rearwardmost locations constitute one or more areas, then the forwardmost toe location and/or the rearwardmost heel location constitute the geographic center of the area or combined areas (irrespective of whether the geographic center itself lies on the component 1000 structure).

Once the longitudinal direction of a component or structure 1000 has been determined with the component 1000 oriented on a horizontal support surface S, planes may be oriented perpendicular to this longitudinal direction (e.g., planes running into and out of the page of FIG. 4). The locations of these perpendicular planes may be specified based on their positions along the longitudinal length L where the perpendicular plane intersects the longitudinal direction between the rearmost heel location RH and the forwardmost toe location FT. In this illustrated example of FIG. 4, the rearmost heel location RH is considered as the origin for measurements (or the "0L position") and the forwardmost toe location FT is considered the end of the longitudinal length of this component (or the "1.0L position"). Plane position may be specified based on its location along the longitudinal length L (between 0L and 1.0L), measured forward from the rearmost heel RH location in this example. FIG. 4 further shows locations of various planes perpendicular to the longitudinal direction (and oriented in the "transverse direction," perpendicular to the longitudinal direction) and located along the longitudinal length L at positions 0.25L, 0.4L, 0.5L, 0.55L, 0.6L, and 0.8L (measured in a forward direction from the rearmost heel location RH). These planes may extend into and out of the page of the paper from the view shown in FIG. 4, and similar planes may be oriented at any other desired positions along the longitudinal length L. While these planes may be parallel to the parallel vertical planes VP used to determine the rearmost heel RH and forwardmost toe FT locations, this is not a requirement. Rather, the orientations of the perpendicular planes along the longitudinal length L will depend on the orientation of the longitudinal direction, which may or may not be parallel to the horizontal surface S in the arrangement/ orientation shown in FIG. 4. The "transverse direction" on a footwear component may be perpendicular to the longitudinal direction and parallel to the horizontal support surface and/or extending along a surface of the footwear component.

II. DETAILED DESCRIPTION OF EXAMPLE ARTICLES OF FOOTWEAR OR OTHER FOOT-RECEIVING DEVICES INCLUDING THIS TECHNOLOGY

Referring to the figures and following discussion, various articles of footwear/foot-receiving devices and features thereof in accordance with aspects of the present technology are disclosed. The footwear depicted and discussed are athletic shoes, and the concepts disclosed with respect to this footwear may be applied to a wide range of athletic footwear styles, including, but not limited to: walking shoes, tennis shoes, golf shoes, soccer shoes, football shoes, basketball shoes, running shoes, track shoes, shoes for track field events (e.g., high jump, triple jump, etc.) and cross-training shoes. In addition, the concepts of the present technology may be applied to a wide range of non-athletic footwear, including work boots, sandals, loafers, and dress shoes, as well as to other foot-receiving devices.

Articles of footwear and/or other foot-receiving devices in accordance with at least some aspects of this technology may include: (a) an upper portion (or other foot-covering member part) formed of one or more parts, wherein the upper portion/foot-covering member includes a lateral side and a medial side, and wherein the upper portion/foot-covering member part at least partially defines a front part of a foot-receiving chamber for the article of footwear/foot-receiving device; and (b) a sole structure (or other foot-supporting member) providing a ground-contacting surface/support base for the article of footwear/foot-receiving device and engaged with and/or secured to the upper portion/foot-covering member part. In addition to the lateral side and medial side, the upper portion may also include a toe portion and/or a rear heel portion, each located between at least a portion of the lateral side and medial side. As described herein, the lateral side, the medial side, and the toe portion may collectively be referred to as the "main body." A dynamic fit heel portion may also be included with the upper portion, e.g., in an area of, proximate to, and/or surrounding the rear heel portion. The dynamic fit heel portion may include: (a) a lower heel counter extending from a lower portion of the lateral side, around a rear heel portion, and to a lower portion of the medial side; (b) an upper heel collar extending from an upper portion of the lateral side, around the rear heel portion, and to an upper portion of the medial side; and (c) an expandable joint provided between the lower heel counter and the upper heel collar and formed of a material having a higher flexibility and a higher stretch than the lower heel counter and the upper heel collar. The upper heel collar may define, at least in part, the foot-receiving chamber. The lower heel counter, the upper heel collar, and the expandable joint may be configured to align with portions of a heel and ankle of a wearer so as to provide a dynamic heel and ankle fit.

The expandable joint may formed from a single textile layer with mechanical stretch fabric. The dynamic fit heel portion may be configured to align with the heel of the wearer so as to prevent or reduce heel slip. In some examples, the upper heel collar may include at least one lace receiving element on a portion proximate to the upper portion of the lateral side or the upper portion of the medial side.

The dynamic fit heel portion may include a reinforced collar aligned with at least a portion of the upper heel collar and at least a portion of the lower heel counter. The reinforced collar may have a higher stiffness than the lower heel counter, the upper heel collar, and the expandable joint. The reinforced collar may connect the upper heel collar to the lower heel counter by at least one anchor point. The at least one anchor point may include a medial side anchor point, a lateral side anchor point, and a rear central anchor point.

In some examples, the dynamic fit heel portion may include the at least one anchor point, such as a rear anchor plate over the rear heel portion. The rear anchor plate may be connected to a portion of the lower heel counter and the upper heel collar. The rear anchor plate may include a finger loop.

The dynamic fit heel portion may include at least one side anchor on a lateral side or a medial side of the dynamic heel portion. The at least one side anchor may connect the lower heel counter to the upper heel counter. The at least one side anchor may be positioned on the article of footwear so as to align with malleolus locations of the ankle of the wearer.

Still additional aspects of this technology relate to methods of making and/or methods of using articles of footwear and/or other foot-receiving devices, e.g., of the types and having the structures described above (and described in more detail below).

Given the above background and general description of aspects and examples of this technology, a more detailed description of specific examples of articles of footwear in accordance with at least some examples of this technology follows.

III. DETAILED DESCRIPTION OF SPECIFIC EXAMPLE ARTICLES OF FOOTWEAR INCLUDING ASPECTS OF THIS TECHNOLOGY

Figure 1A:
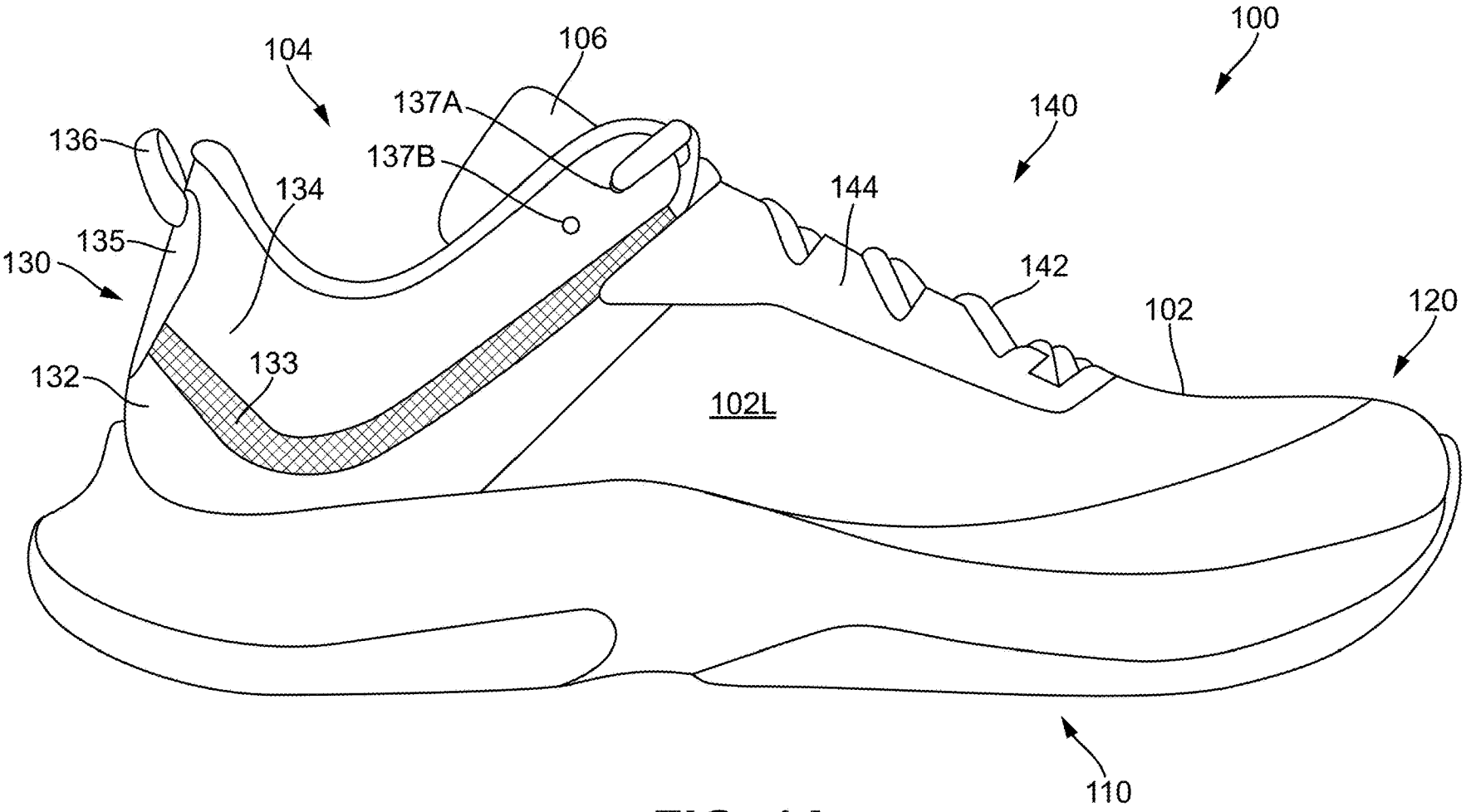
FIGS. 1A through 1F provide various views of articles of footwear in accordance with some examples and aspects of the present disclosure.
Figure 1B:
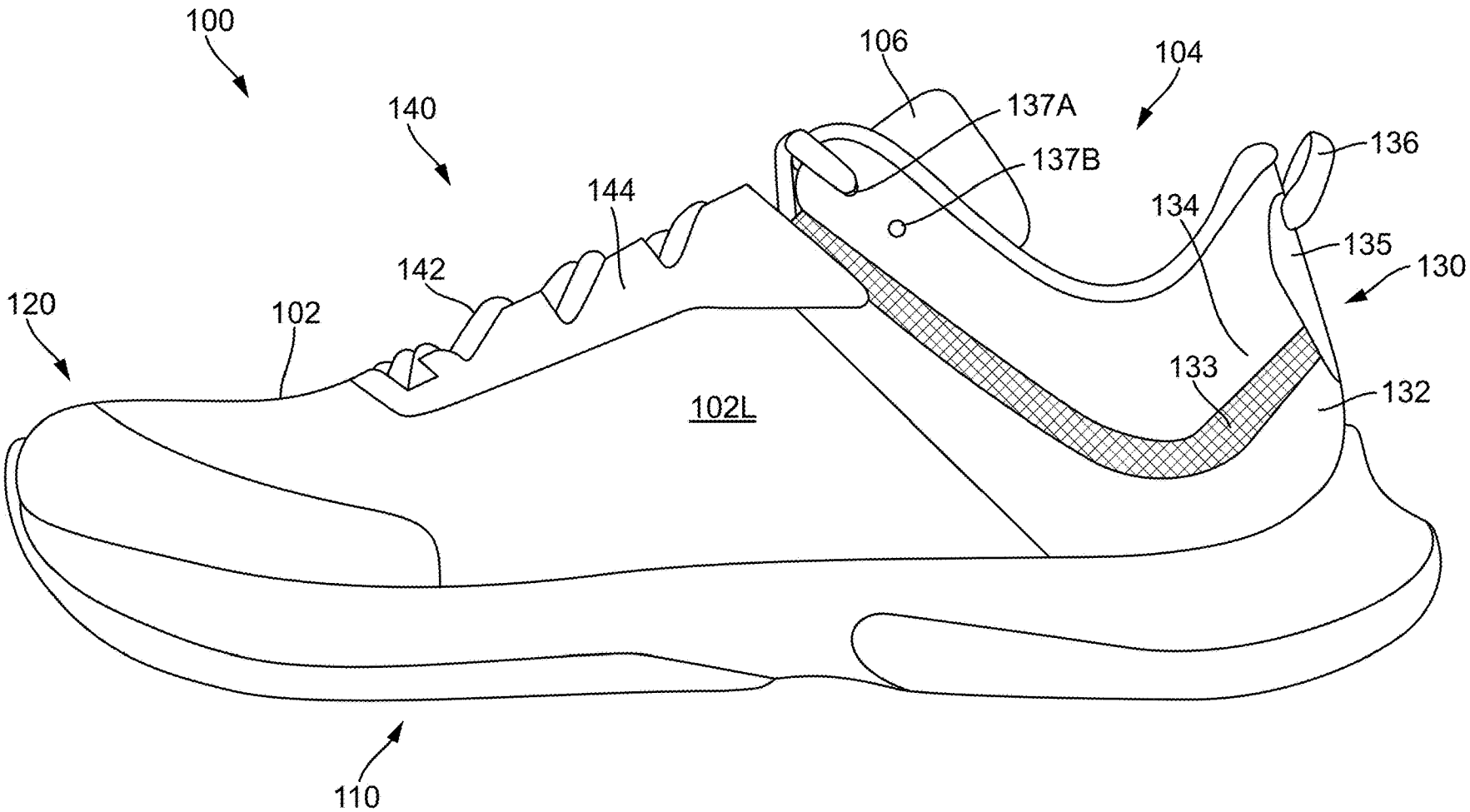
Figure 1C:
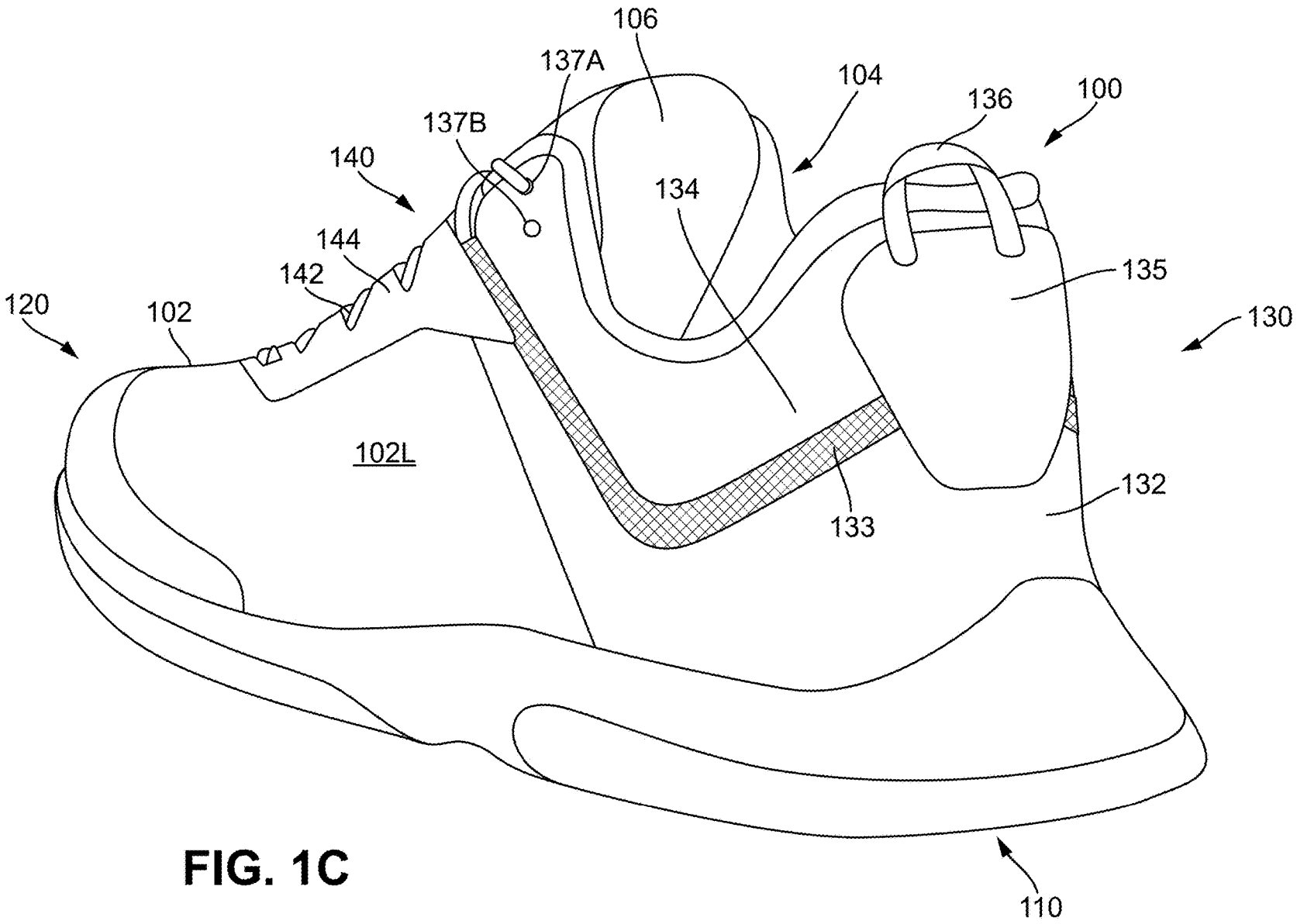
Figure 1D:
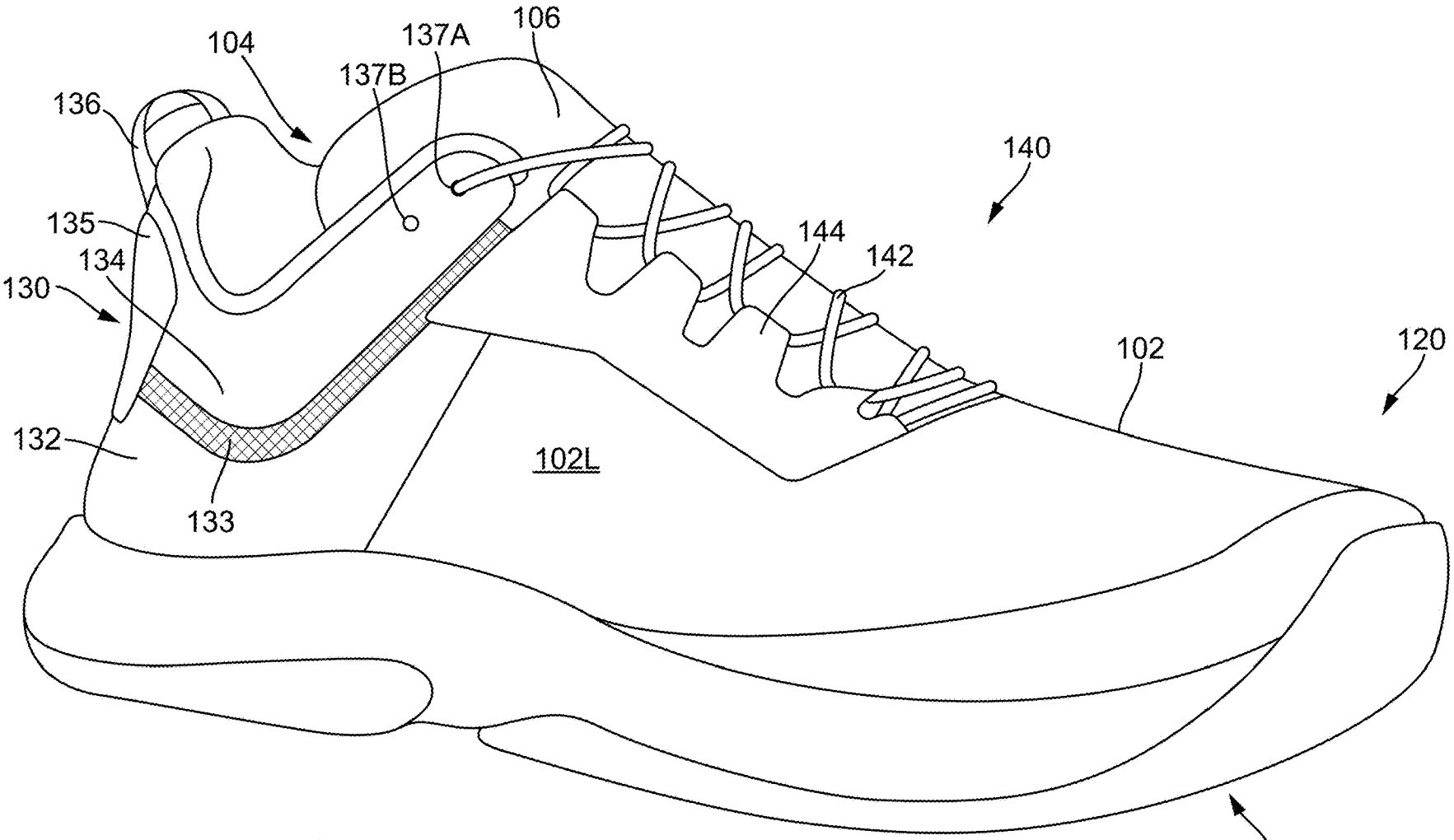
Figure 1F:
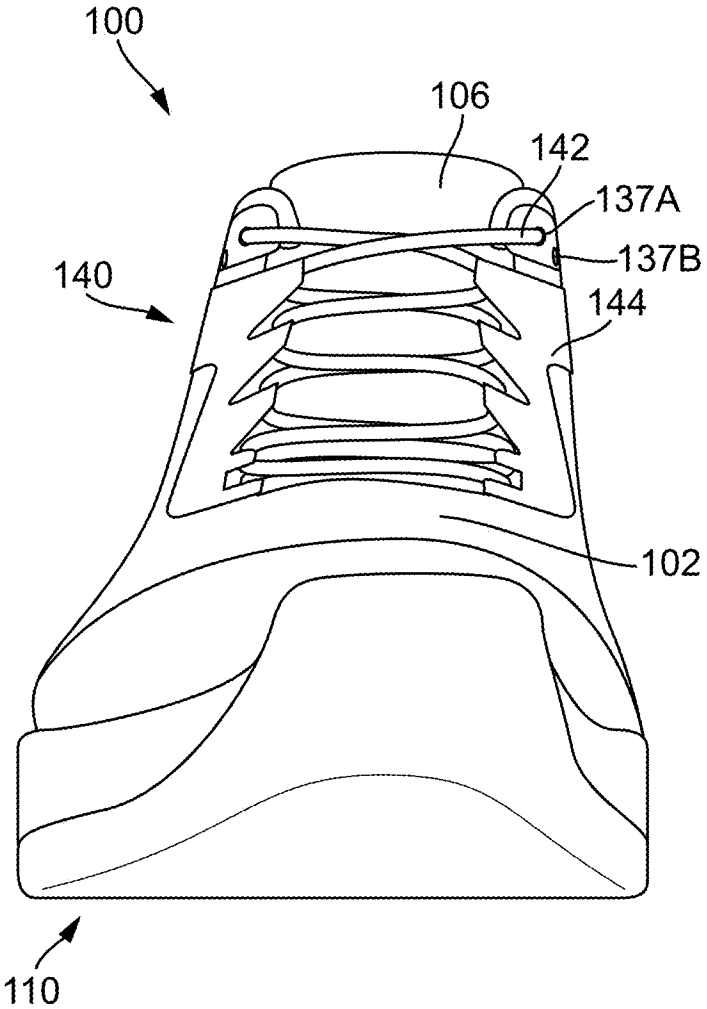
Figure 1E:
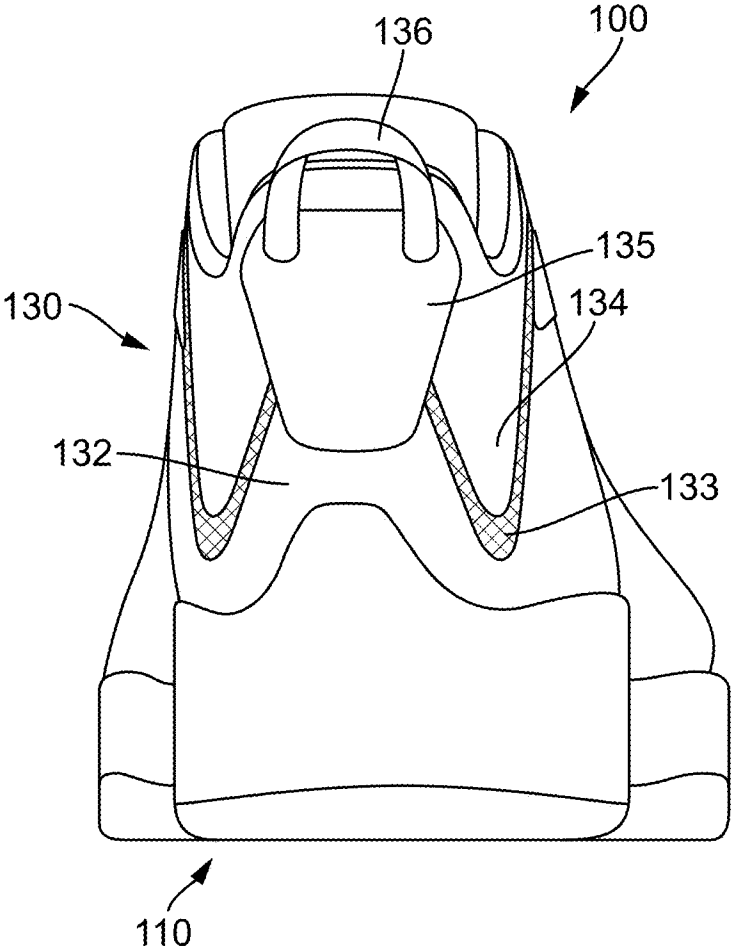
Figure 2A:
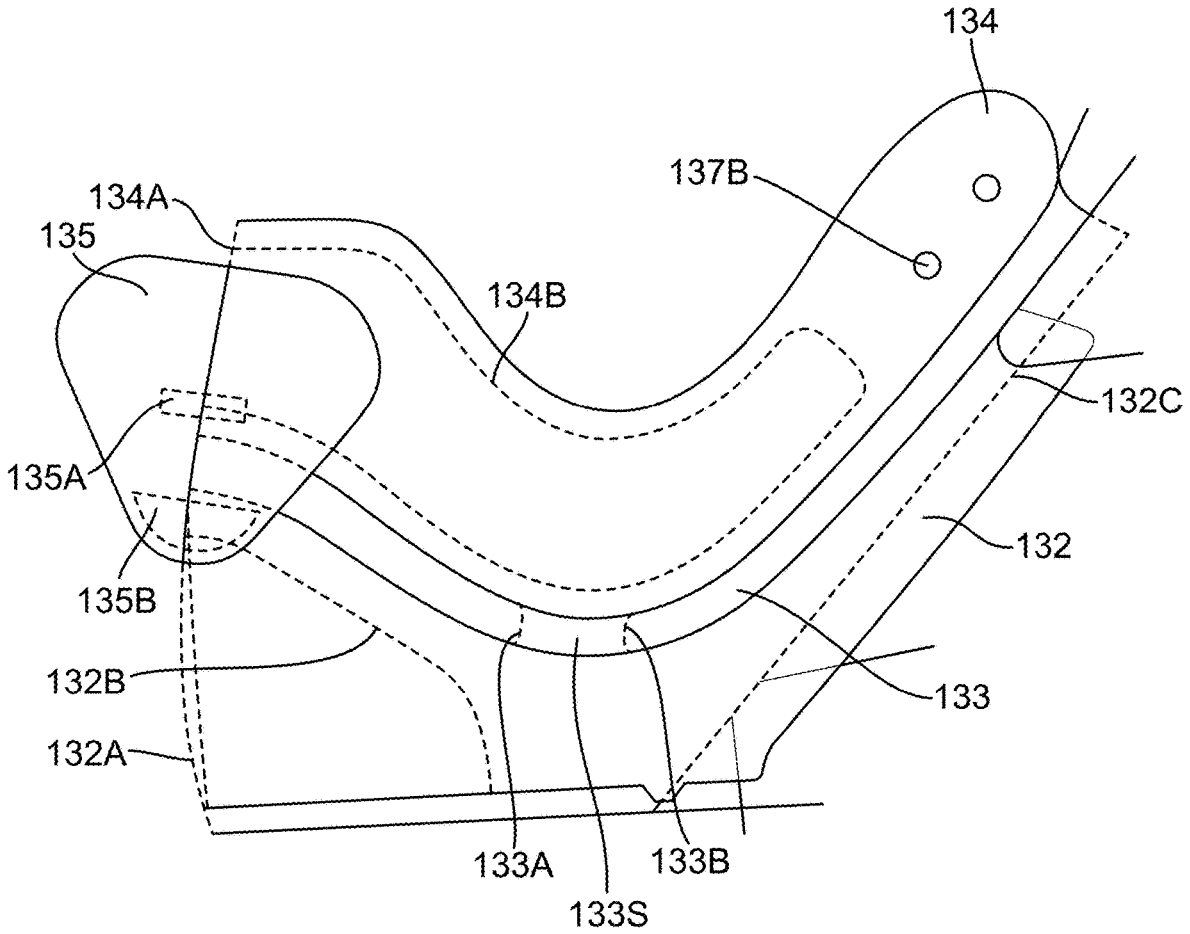
FIGS. 2A through 2B provide various views of components of an example article of footwear in accordance with some examples and aspects of the present disclosure.
Figure 2B:
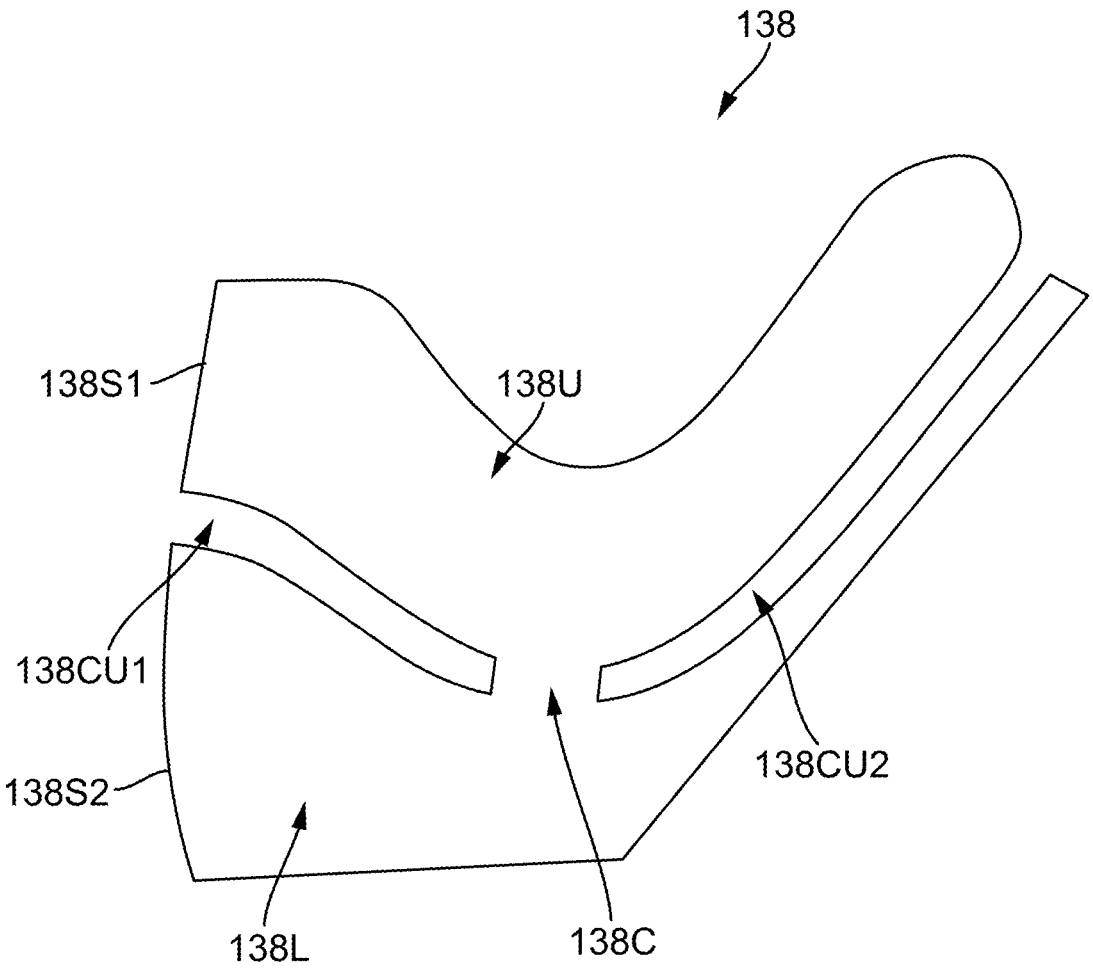
Figure 3:
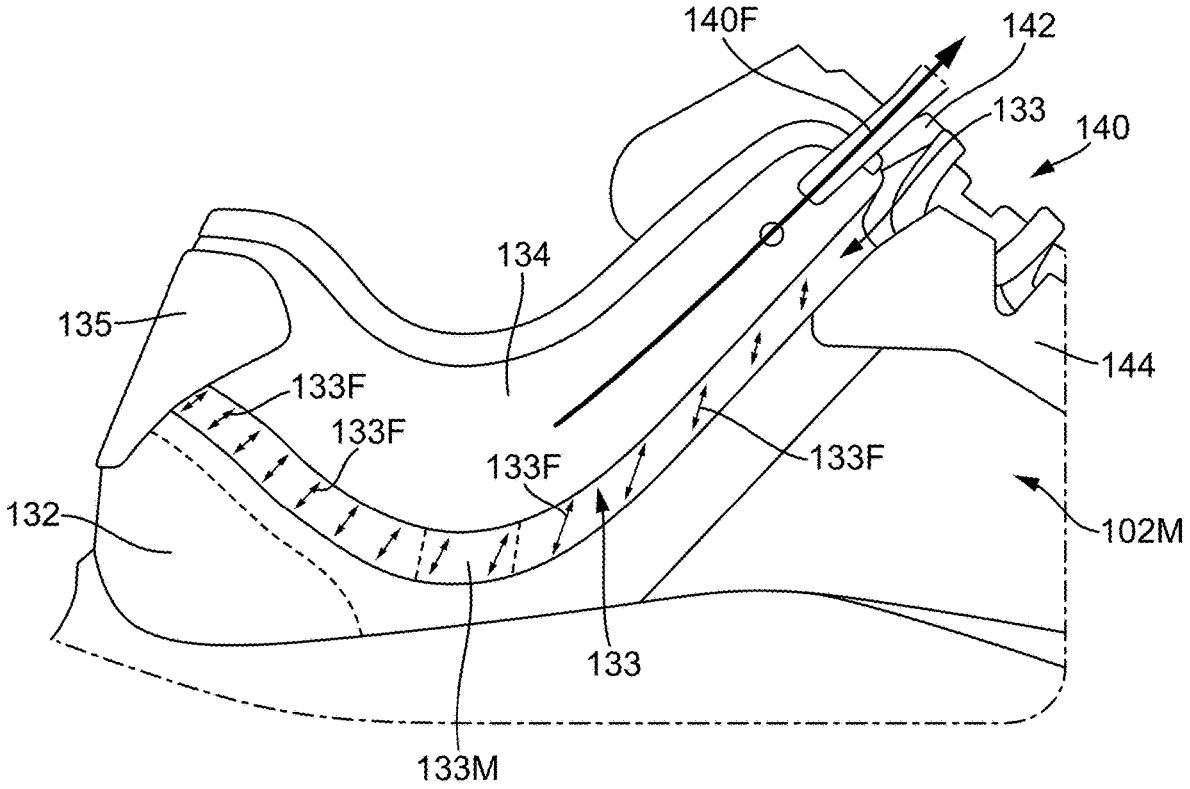
FIG. 3 provides a view of a component of an example article of footwear showing operation of various forces when securing the example article of footwear in accordance with at least some examples and aspects of the present disclosure.

FIGS. 1A-1F provide various views of example articles of footwear 100 and/or component parts thereof in accordance with at least some examples of this technology. This example article of footwear 100 includes an upper portion 102 formed of one or more parts, and in particular, this upper portion 102 at least partially defines a front or forward part of a foot-receiving chamber 104 for the article of footwear 100. As shown in FIGS. 1A-1F, the upper portion 102 includes a lateral side 102L, a medial side 102M, and a central portion 102C connecting the lateral side 102L and medial side 102M (and extending across an instep area of the footwear 100). FIGS. 2A-3 provide additional views of a similar article of footwear 100, and the same reference numbers are used in FIGS. 2A-3 to refer to the same or similar parts as in FIGS. 1A-1F.

More specifically: FIG. 1A provides a lateral side view of an example article of footwear 100; FIG. 1B provides a lateral medial side view of this same example article of footwear 100; FIG. 1C provides a rear-lateral perspective view of this same example article of footwear 100; FIG. 1D provides a front-lateral perspective view of this same example article of footwear 100; FIG. 1E provides a rear view of this same example article of footwear 100; FIG. 1F provides a front view of this same example article of footwear 100; FIG. 2A provides a lateral side view of a dynamic fit heel portion 130 of an article of footwear according to some examples of this technology; FIG. 2B provides a lateral side view of a reinforcing collar 138 of a portion of the dynamic fit heel portion of FIG. 2A; and FIG. 3 schematically shows operational of various forces when securing the article of footwear 100 of FIGS. 1A-1F. More detailed descriptions of these figures and these example articles of footwear 100 follow.

The upper portion 102 may be made from any desired materials, constructions, parts, and/or number of parts without departing from this technology, including conventional materials, constructions, parts, and/or numbers of parts as are known and used in the footwear art. Further, this example article of footwear 100 includes a sole structure 110. The sole structure 110 may include a midsole (e.g., one or more impact force attenuating components, such as one or more fluid-filled bladders, one or more polymeric foam components, one or more mechanical shock absorber structures, etc.) and/or an outsole (e.g., ground-contacting components, formed from rubber or other materials, and the sole structure further may include traction enhancing components, such as treads, cleats, etc.). The sole structure 110 (e.g., a midsole and/or outsole) may be made from any desired materials, constructions, parts, and/or number of parts without departing from this technology, including conventional materials, constructions, parts, and/or numbers of parts as are known and used in the footwear art.

If desired, the upper portion 102 may include a lateral side 102L, a medial side 102M, a central portion 102C, a toe portion 120, and a heel portion 130 (also referred to herein as a rear heel portion 130 or a dynamic fit heel portion 130). The dynamic fit heel portion 130 may include a lower heel counter 132 extending from the lateral side 102L of the upper portion 102, around a rear heel portion 130R, and to the medial side 102M of the upper portion 102. The dynamic fit heel portion 130 may also include an upper heel collar 134 above the lower heel counter 132 and extending from the lateral side 102L of the upper portion 102, around the rear heel portion 130R, and to the medial side 102M of the upper portion 102. In some examples, the upper heel collar 134 may define, at least in part, a foot-receiving chamber 104. An expandable joint 133 may be provided between the lower heel counter 132 and the upper heel collar 134.

The lower heel counter 132, expandable joint 133, and upper heel collar 134 may be configured to operate together to provide a dynamic heel and ankle fit. For example, the lower heel counter 132, the upper heel collar 134, and the expandable joint 133 may be configured to align with portions of a heel and ankle of a wearer so as to provide a dynamic heel and ankle fit. The dynamic fit heel portion 130 may also be configured to align with the heel of the wearer so as to prevent or reduce heel slip. The dynamic fit heel portion 130 may further include a rear anchor plate 135 over the rear heel portion and connected to a portion of the lower heel counter 132 and the upper heel collar 134. In some examples, the rear anchor plate 135 may include a finger loop 136.

A material forming the expandable joint 133 may have a higher degree of flexibility and stretchability than the lower heel counter 132 and the upper heel collar 134. For instance the expandable joint 133 may be formed from a single textile layer or a flexible textile component. The expandable joint 133 may include a mechanical stretch fabric. Such mechanical stretch fabrics may include fabrics having stretch properties without the use of spandex or other stretch yarns, where stretch is created in the finishing process, in which high twist polyester yarn, once woven, has a small amount of stretch. In some examples, mechanical stretch fabrics may include polyester fabrics having a horizontal two-way stretch. The elasticity of the polyester fabric and the criss-cross processing of the weaving process allows the fabric to have a stretchable feel. Additionally, many mechanical stretch fabrics provide enhanced breathability and softness and are less prone to wrinkling.

In some embodiments, the lower heel counter 132 and the upper heel counter 134 may be substantially inelastic. In other words, neither lower heel counter 132 nor upper heel counter 134 appreciably stretches under loads that might be imposed by a wearer. In some examples, the lower heel counter 132 and the upper heel counter 134 may be substantially inelastic due to coupling to the reinforcing collar 138 (shown in FIG. 2B). Because of the way in which these components are attached to the dynamic fit heel portion 130 in the article of footwear, however, a flexible heel and ankle fit is accomplished. Portions of the lower heel counter 132 and the upper heel counter 134 may be anchored to the dynamic fit heel portion 130 at various anchor points, such as medial anchor point 133M, lateral anchor point 133L, and/or rear anchor plate 135. Thus, one or more anchors plates may serve to hold the general structure of the dynamic fit heel portion 130.

Conversely, the expandable joint 133 accommodates a flexible and stretchable fit around a heel and ankle of a wearer. In particular, the expandable joint stretches to fit around and over malleolus areas of a wearer's ankle and assists in securing a wearer's heel in the article of footwear 100. As indicated in FIGS. 1A-1F, the expandable joint 133 may be shaped so as to align with lateral, medial, and rear malleus regions of a foot. Accordingly, the flexible portions of the dynamic fit heel component (e.g., the expandable joint 133) being positioned relative to inelastic components (e.g., the lower heel counter 132 and the upper heel counter 134) allows for a more flexible and adjustable heel and ankle fit of the article of footwear 100.

The upper portion 102 and/or the sole structure 110 may include at least some portion of one or more structures to help secure the article of footwear 100 to a wearer's foot, such as a conventional lace system, one or more straps (e.g., releasably fixed in place by buckles, buttons, hook-and-loop fasteners, or the like). One aspect of this technology, however, as described in detail below, relates to a dynamic fit heel portion 130 for providing the footwear 100 with a dynamic heel and ankle fit to a wearer's foot. These dynamic fit heel portions 130 allow for a more customized fit around particular dimensions of a wearer's ankle and heel, as will be described in more detail below. In at least some examples of this technology, a securing system 140 may function with the dynamic fit heel portion 130 to provide ease of securing the footwear and an enhanced ankle and heel fit. In some instances, the securing system 140 may include laces, straps, and/or other types of footwear securing systems. As shown in FIGS. 1A-1F, the securing system 140 may include a lacing system 142 and a lace supporting structure 144 supporting the lacing system 142 thereon and positioned above a tongue 106 of the footwear 100. The lacing system 142 may extend from the foot-receiving chamber 104 to the toe portion 120. The upper heel collar 134 may include at least one lace receiving element of the lacing system 142 on a portion proximate to the lateral side 102L and/or the medial side 102M. For example, as shown in FIGS. 1A-1F, lace securing elements 137A and 137B are provided on a lateral side and a medial side of the upper heel collar 134.

In some examples, the lower heel counter 132 may extend from a lower portion of the lateral side 102L of the main body, around the rear heel portion 130R, and to a lower portion of the medial side 102M of the main body. And the upper heel collar 134 may extend from an upper portion of the lateral side 102L, around the rear heel portion 130R, and to an upper portion of the medial side 102M. Accordingly, and as described further herein, the dynamic fit heel portion 130 may be configured to align with portions of a heel and ankle of a wearer so as to provide a dynamic heel and ankle fit by being configured to adjust over portions of a heel of a wearer when adjusting a looseness or tightness of the lacing system 140.

FIGS. 2A-2B and 3 show various aspects of the dynamic fit heel portion 130. The sole structure 110 provides a ground-contacting surface for the article of footwear 100 and may be engaged with at least one of the upper portion 102 and/or the dynamic fit heel portion 130. Alternatively, if desired, one or more components of the dynamic fit heel portion 130 may be formed as part of the sole structure 110 (e.g., part of a midsole and/or outsole component).

Referring to FIG. 2A, a section of an article of footwear 100 with additional details of the dynamic fit heel portion 130 is shown. As shown in FIG. 2A, one side of a portion of a dynamic fit heel portion 130, e.g., a lateral side or a medial side, is depicted. An outline of an under layer of the reinforcing collar 138 is partially shown in dotted line. The reinforcing collar 138 may be positioned on an inner layer of the dynamic fit heel portion 130, and may be positioned directly beneath portions of the lower heel counter 132, the upper heel collar 134, the expandable joint 133, and/or the rear anchor plate 135. Portions of the reinforcing collar 138 may be affixed or attached to other portions of the dynamic fit heel portion 130 as illustrated in FIG. 2A. For example, upper heel collar side seam 134B that affixes portions of the upper heel collar 134 to the reinforcing collar 138. Upper heel collar rear seam 134A may affix one side, e.g., a lateral or a medial side, of an upper heel collar 134 to a corresponding other side of an upper heel collar 134. Still, in some examples, an upper heel collar 134 may be a single unitary structure covering both medial and lateral sides of a dynamic fit heel portion 130.

Still referring to FIG. 2A, rear anchor plate 135 may connect the lower heel counter 132 and the upper heel collar 134 via an upper anchor plate seam 135A that connects to the upper heel collar 134 and a lower anchor plate seam 135B that connects to the lower heel counter 132. With the rear anchor plate 135 having such seams, the rear anchor plate 135 may essentially float over the expandable joint 133. Lower heel counter side seam 132B may affix portions of the lower heel counter 132 to the reinforcing collar 138. Lower heel counter rear seam 132A may affix one side, e.g., a lateral or a medial side, of a lower heel counter 132 to a corresponding other side of a lower heel counter 132. Still, in some examples, a lower heel counter 132 may be a single unitary structure covering both medial and lateral sides of a dynamic fit heel portion 130. Additionally, a lower heel counter forward side seam 132C may affix forward side portions of the lower heel counter 132 to the reinforcing collar 138, e.g., in an area below the second cutout region 138CU2 of the reinforcing collar 138 shown in FIG. 3. Connect portion 138C, that connects the upper collar portion 138U to the lower collar portion 138L (as shown in FIG. 3), are indicated in FIG. 2B by first expandable joint seam 133A and second expandable joint seam 133B that floats underneath the expandable joint 133.

Still further, the dynamic fit heel portion 130 may include side anchors, such as a lateral side anchor on a lateral or a medial side anchor on a medial side of the dynamic fit heel portion 130. In the example shown in FIG. 2A, one such side anchor 133S is shown. Such side anchors may connect the lower heel counter 132 to the upper heel collar 134 and may be positioned on the article of footwear so as to align with malleolus locations of the ankle of the wearer. A rear central anchor may also be provided with the dynamic fit heel portion 130 via the rear anchor plate 135.

Referring to FIG. 2B, the dynamic fit heel portion 130 may include a reinforcing collar 138 aligned with at least a portion of the upper heel collar 134 and at least a portion of the lower heel counter 132. The reinforcing collar 138 may have a higher stiffness than the lower heel counter 132, the upper heel collar 134, and the expandable joint 133. The reinforcing collar 138 may connect the upper heel collar 134 to the lower heel counter 132 by at least one anchor point. As shown in FIG. 2A, the at least one anchor point includes a connector portion 138C (e.g., on both a medial side and a lateral side). In some examples, a rear central anchor point may also be included with the reinforced collar. The at least one side anchor may be positioned on the article of footwear so as to align with malleolus locations of the ankle of the wearer.

The reinforcing collar 138 may be made of any desired material(s), including materials known and used in footwear construction, such as one or more of: plastic materials, non-foam plastic materials, thermoplastic materials, thermosetting materials, polyether block amide materials, fiber reinforced plastic materials, and/or metal or metal alloy materials. In some more specific examples, the reinforcing collar 138 may be made from a rigid material, such as a thermoplastic polyurethane material, a polyether block amide material (e.g., PEBAX®, available from Arkema), or the like. The reinforcing collar 138 may be constructed of a material that is sufficiently rigid to support the actions and functions described in more detail herein (e.g., providing a reinforced area around stretchable sections of the dynamic fit heel portion 130), but it may have some flexibility and/or resiliency (e.g., under forces from the wearer's foot) to not adversely affect comfort and/or performance for the wearer (e.g., flex somewhat as a wearer lands a step and then return to its original shape and/or configuration, provide desired support characteristics, etc.).

The reinforcing collar 138 of this illustrated example supports and/or defines at least one reinforcing component for the dynamic fit heel portion. In the illustrated example, a single side (e.g., a medial side or a lateral side) of the reinforcing collar r 138 is shown. However, it is understood that the reinforcing collar 138 may extend even along both side, e.g., by addition of a mirror image of the reinforcing collar 138 shown in FIG. 2B. For example, corresponding sides of the reinforced collar may be attached to one another at a first seam 138S1 and/or a second seam 138S2. As shown in FIG. 2B, a single side of the reinforcing collar 138 may support and/or define: (a) an upper collar portion 138U that extends from a central heel region to an upper lace support region (b) a lower collar portion 138L that extends from a central heel region to a side of the upper portion 102 and/or a lower lace support region; and/or (c) a connector portion 138C that connects the upper collar portion 138U to the lower collar portion 138L. Additionally or alternatively, one or more additional connector portions may be provided on the reinforced collar. In between the upper collar portion 138U to the lower collar portion 138L are a first cutout region 138CU1 and a second cutout region 138CU2, formed on either side of the connector portion 138C.

The first cutout region 138CU1 and second cutout region 138CU2 may extend any desired longitudinal extent of the article of footwear 100. In the illustrated example, as shown in FIG. 2B, the first cutout region 138CU1 extends from a central heel region to a side of the upper portion 102, e.g., corresponding to a portion of the upper portion 102 between planes perpendicular to the longitudinal direction located at P=0.15 L and P=0.5 L, and in some examples, between planes perpendicular to the longitudinal direction located at P=0.2 L and P=0.3 L. The second cutout region 138CU2 may begin close to an end of the first cutout region 138CU1 (and separated from the first cutout region 138CU1 by the connector portion 138C). As shown in the illustrated example (FIG. 2B), the second cutout region 138CU2 may extend from the location of the connector portion 138C to a perpendicular plane located P=0.4 and P=0.7 L, and in some examples, at P=0.55 L in this illustrated example (FIG. 2B). The connector portion 138C may be positioned to generally align with a malleolus region of a wearer's foot, with the first cutout region 138CU1 and second cutout region 138CU2 extending on both sides thereof.

FIGS. 1A-1F, 2A-2B, and 3 show that the dynamic fit heel portion 130 of this example, and particularly the arrangement of components of the dynamic fit heel portion 130 that form a multi-part structure. The upper heel collar 134 to the lower heel counter 132 may form a heel counter type structure, e.g., for supporting the wearer's heel. Outer portions of the upper heel collar 134 to the lower heel counter 132 may be made from a relatively rigid material, such as one or more of the materials described above for the construction of the reinforcing collar 138. Inner portions of the upper heel collar 134 to the lower heel counter 132 also may directly engage the wearer's heel and/or may be made from a comfort enhancing material (e.g., soft materials, polymeric foam, fabric, textile, and the like). The outer portions may be harder and/or more rigid than the inner portions.

Referring to FIG. 3, a schematic illustration of operation of various forces when securing the article of footwear, showing upper portions of a medial side 102M and various portions of a dynamic heel fit portion 130. As the securing system 140 is tightened by applying a tightening force 140F on the lacing system 142 in in the direction of 140F while the lace securing structure generally remains in place. The tightening force 140F causes the expandable joint 133 to stretch to two directions as shown by the stretch direction 133F. As such, portions of the dynamic fit heel portion 130 may stretch and fit around the heel and ankle of the wearer, e.g., such that lateral and medial sides of the expandable joint 133 fit around malleolus areas of a wearer's ankles, with the upper heel collar 134 positioned directly above and the lower heel counter 132 positioned directly below and thereby provided a customized heel and ankle fit for a particular wearer. Movement of portions of the dynamic heel fit portion 130 may be limited by various anchor points as the tightening force 140F is being applied. For example, the rear anchor plate 135 and medial side anchor 133M (and, in some examples, the lateral side anchor 133L, not shown in FIG. 3) may limit movement of the expandable joint 133 and maintain the general structure of the dynamic heel fit portion 130. While only a medial side is illustrated in FIG. 3, it is understood that the lateral side would include similar features with respect to those shown in FIG. 3, but altered to the extend to fit around a lateral portion of a heel rather than a medial portion of a heel.

In some examples, the dynamic fit heel portion 130 (also referred to herein as a heel support component) may include the lower heel counter 132 extending around the rear heel portion 130R, the upper heel collar 134 (defining, at least in part, the foot-receiving chamber 104) extending around the rear heel portion 130R, and the expandable joint 133 (formed of a single textile layer with a mechanical stretch fabric) provided between the lower heel counter 132 and the upper heel collar 134. The lower heel counter 132, the upper heel collar 134, and the expandable joint 133 may be configured to align with portions of a heel and ankle of a wearer so as to provide a dynamic fit around malleolus areas of a wearer's foot. In some examples, the material forming the expandable joint 133 may have a higher flexibility and a higher stretch than the lower heel counter 132 and the upper heel collar 134. The dynamic fit heel portion 130 may also include a reinforcing collar 138 aligned with at least a portion of the upper heel collar 134 and at least a portion of the lower heel counter 132. The reinforcing collar 138 may have a higher stiffness than the lower heel counter 132, the upper heel collar 134, and the expandable joint 133. In some examples, the reinforcing collar 138 may connect the lower heel counter 132 to the upper heel collar 134. The dynamic fit heel portion 130 may also include a rear anchor plate 135 over the rear heel portion 130R and connected to a portion of the lower heel counter 132 and the upper heel collar 134.

FIGS. 1A and 1B further illustrate that, in this example, the forwardmost extents of the dynamic fit heel portion 130 (e.g., the forwardmost points of the upper heel collar 134 and the lower heel counter 132) may extend to the securing system 140 and may be located forward of a plane perpendicular to the longitudinal direction located at P=0.4 L, and in some examples, forward of a plane perpendicular to the longitudinal direction located at P=0.45 L or even forward of a plane perpendicular to the longitudinal direction located at P=0.5 L. While the dynamic fit heel portion 130 is shown extending around both sides of the rear heel area, in some examples of this technology, the rearwardmost extents of the dynamic fit heel portion 130 (e.g., the rearwardmost point of the upper heel collar 134 and the lower heel counter 132) may be located between planes perpendicular to the longitudinal direction located at P=0.05 L and P=0.2 L, and in some examples, between planes perpendicular to the longitudinal direction located at P=0.1 L and P=0.15 L.

Many variations and/or combinations of the specific structures and/or features described above may be used without departing from this technology. As one specific example, if desired, one or more additional expandable joint 133 may be provided, e.g., by have separate medial and lateral expandable joints. Multiple expandable joints 133 may be provided on each side of the article of footwear 100 in a variety of different combinations. Additionally or alternatively, many different types of mechanical linkages and/or structures can be used, e.g., for attaching the upper heel collar 134 and the lower heel counter 132 to the reinforcing collar 138.

III. CONCLUSION

Various aspects of the present disclosure are described above and in the accompanying drawings with reference to a variety of embodiments and/or alternatives. The purpose served by the disclosure, however, is to provide examples of various features and concepts related to the present disclosure, not to limit the scope of the present disclosure. One skilled in the relevant art will recognize that numerous variations and modifications may be made to the features described above without departing from the scope of the present disclosure, as defined by the appended claims.

Embodiments of the present disclosure also include articles of footwear that combine features from one or more of the abovementioned embodiments. Although some embodiments are described below in connection with a certain specific article of footwear, and/or by describing certain shapes, sizes and locations of various footwear elements, any specifics are merely examples. Similarly, various examples may include footwear intended for certain activities. Other embodiments include shoes intended for use in activities that may not be explicitly mentioned herein. Embodiments are not limited to complete shoes. Thus, some embodiments include portions of shoes, processes for fabricating shoes or shoe portions, and processes of using shoes or shoe portions.

Additional embodiments include numerous variations on footwear 100. Numerous materials in addition to those specifically identified can be employed. The upper portion 102 and/or the dynamic fit heel portion 130 may have numerous alternate constructions. In some embodiments, the dynamic fit heel portion 130 may not extend completely around the foot receiving opening and may only extend from the rear heel portion 130R to portions of the medial side and the lateral side. Features of the article of footwear 100 may be combined with other features, including but not limited to various features described below.

In addition to articles of footwear, aspects of this disclosure can be practiced with other types of "foot-receiving devices" (i.e., any device into which a user places at least some portion of his or her foot). In addition to all types of footwear or shoes (e.g., as described above), foot-receiving devices include, but are not limited to: boots, bindings and other devices for securing feet in snow skis, cross country skis, water skis, snowboards, and the like; boots, bindings, clips, or other devices for securing feet in pedals for use with bicycles, exercise equipment, and the like; boots, bindings, clips, or other devices for receiving feet during play of video games or other games; and the like. Such foot-receiving devices may include: (a) a foot-covering component (akin to a footwear upper) that at least in part defines an interior chamber for receiving a foot; and (b) a foot-supporting component (akin to the footwear sole structure) engaged with the foot-covering component. Structures for providing the desired relative rearfoot movement with respect to the forefoot, as described above, may be incorporated in the foot-covering and/or foot-supporting component of any desired type of foot-receiving device.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. As but one example, techniques such as are described herein can be used to fabricate articles other than footwear uppers. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from above-described embodiments are the within the scope of the invention. With regard to claims directed to an apparatus, an article of manufacture or some other physical component or combination of components, a reference in the claim to a potential or intended wearer or a user of a component does not require actual wearing or using of the component or the presence of the wearer or user as part of the claimed component or component combination. With regard to claims directed to methods for fabricating an component or combination of components, a reference in the claim to a potential or intended wearer or a user of a component does not require actual wearing or using of the component or the participation of the wearer or user as part of the claimed process.

The invention claimed is:

1. An article of footwear having an upper and a sole structure secured to the upper, the upper comprising:

a main body including a lateral side and a medial side; and a dynamic fit heel portion including:

a lower heel counter extending from a lower portion of the lateral side of the main body, around a rear heel portion, and to a lower portion of the medial side of the main body;

an upper heel collar extending from an upper portion of the lateral side, around the rear heel portion, and to an upper portion of the medial side, wherein the upper heel collar defines, at least in part, a foot-receiving chamber; and an expandable joint provided between the lower heel counter and the upper heel collar, wherein the expandable joint is formed from a single textile layer with mechanical stretch fabric having two-way stretch properties in directions toward and away from the upper heel collar, and has a higher flexibility and a higher stretch than the lower heel counter and the upper heel collar, wherein the lower heel counter, the upper heel collar, and the expandable joint are configured to align with portions of a heel and ankle of a wearer so as to provide a flexible heel and ankle fit.

2. The article of footwear according to claim 1, wherein the dynamic fit heel portion further includes a reinforced collar aligned with at least a portion of the upper heel collar and at least a portion of the lower heel counter, the reinforced collar having a higher stiffness than the lower heel counter, the upper heel collar, and the expandable joint.

3. The article of footwear according to claim 2, wherein the lower heel counter and the upper heel collar are substantially inelastic due to coupling to the reinforcing collar.

4. The article of footwear according to claim 1, wherein the dynamic fit heel portion further includes a rear anchor plate over the rear heel portion and connected to a portion of the lower heel counter and the upper heel collar.

5. The article of footwear according to claim 4, wherein the rear anchor plate includes a finger loop.

6. The article of footwear according to claim 1, wherein the dynamic fit heel portion further includes at least one side anchor on a lateral or a medial side of the dynamic fit heel portion, and wherein the at least one side anchor connects the lower heel counter to the upper heel collar.

7. The article of footwear according to claim 6, wherein the at least one side anchor is positioned on the article of footwear so as to align with malleolus locations of the ankle of the wearer.

8. The article of footwear according to claim 1, wherein the dynamic fit heel portion is configured to align with the heel of the wearer so as to prevent or reduce heel slip.

9. The article of footwear according to claim 1, wherein the dynamic fit heel portion further includes a reinforced collar aligned with at least a portion of the upper heel collar and at least a portion of the lower heel counter and connecting the upper heel collar to the lower heel counter by at least one anchor point.

10. The article of footwear according to claim 9, wherein the at least one anchor point includes a medial side anchor point, a lateral side anchor point, and a rear central anchor point.

11. The article of footwear according to claim 1, wherein the upper heel collar includes at least one lace receiving element of a portion proximate to the upper portion of the lateral side or the upper portion of the medial side.

12. A heel support component for an article of footwear, comprising:

a lower heel counter extending around a rear heel portion;

an upper heel collar extending around the rear heel portion; and an expandable joint provided between the lower heel counter and the upper heel collar, wherein the expandable joint is formed from a single textile layer with a mechanical stretch fabric having two-way stretch properties, wherein the lower heel counter, the upper heel collar, and the expandable joint are configured to align with portions of a heel and ankle of a wearer so as to provide a flexible fit around a malleolus areas of a wearer's foot.

13. The heel support component according to claim 12, further comprising a reinforced collar aligned with at least a portion of the upper heel collar and at least a portion of the lower heel counter, the reinforced collar having a higher stiffness than the lower heel counter, the upper heel collar, and the expandable joint.

14. The heel support component according to claim 13, wherein the lower heel counter and the upper heel collar are substantially inelastic due to coupling to the reinforcing collar.

15. The heel support component according to claim 12, further comprising a rear anchor plate over the rear heel portion and connected to a portion of the lower heel counter and the upper heel collar.

16. The heel support component according to claim 12, further comprising at least one side anchor on a lateral or a medial side of the heel support component, and wherein the at least one side anchor connects the lower heel counter to the upper heel collar.

17. The heel support component according to claim 16, wherein the at least one side anchor is positioned on the article of footwear so as to align with malleolus locations of the ankle of the wearer.

18. The heel support component according to claim 12, further comprising a reinforced collar aligned with at least a portion of the upper heel collar and at least a portion of the lower heel counter and connecting the upper heel collar to the lower heel counter by at least one anchor point.

19. The heel support component according to claim 18, wherein the at least one anchor point includes a medial side anchor point, a lateral side anchor point, and a rear central anchor point.

20. An article of footwear having an upper that define a foot-receiving chamber and a sole structure secured to the upper, the upper comprising:

a main body including a lateral side and a medial side; and a dynamic fit heel portion including:

a lower heel counter extending from a lower portion of the lateral side of the main body, around a rear heel portion, and to a lower portion of the medial side of the main body;

an upper heel collar extending from an upper portion of the lateral side, around the rear heel portion, and to an upper portion of the medial side, wherein the upper heel collar defines, at least in part, the foot-receiving chamber;

an expandable joint provided between the lower heel counter and the upper heel collar; and a reinforced collar aligned with at least a portion of the upper heel collar and at least a portion of the lower heel counter and connecting the upper heel collar to the lower heel counter by at least one anchor point interior to the upper heel collar and the lower heel counter, wherein the dynamic fit heel portion is configured to align with portions of a heel and ankle of a wearer and is configured to adjust over portions of a heel of a wearer.

* * * * *